US011025010B2

(12) United States Patent
Hsiao et al.

(10) Patent No.: US 11,025,010 B2
(45) Date of Patent: Jun. 1, 2021

(54) HIGH FREQUENCY ELECTRICAL CONNECTOR

(71) Applicants: FU DING PRECISION INDUSTRIAL (ZHENGZHOU) CO., LTD., Zhengzhou (CN); FOXCONN INTERCONNECT TECHNOLOGY LIMITED, Grand Cayman (KY)

(72) Inventors: Shih-Wei Hsiao, New Taipei (TW); Yu-San Hsiao, New Taipei (TW); Yen-Chih Chang, New Taipei (TW); Na Yang, Kunshan (CN); Meng Liu, Kunshan (CN); Yu-Ke Chen, Kunshan (CN)

(73) Assignees: FU DING PRECISION INDUSTRIAL (ZHENGZHOU) CO., LTD., Zhengzhou (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/718,200

(22) Filed: Dec. 18, 2019

(65) Prior Publication Data

US 2020/0194914 A1 Jun. 18, 2020

(30) Foreign Application Priority Data

Dec. 18, 2018 (CN) ..... 201811548616.7

(51) Int. Cl.

| | |
|---|---|
| ***H01R 13/64*** | (2006.01) |
| ***H01R 13/6473*** | (2011.01) |
| ***H01R 13/6474*** | (2011.01) |

(52) U.S. Cl.
CPC ..... *H01R 13/6473* (2013.01); *H01R 13/6474* (2013.01)

(58) Field of Classification Search
None
See application file for complete search history.

(56) References Cited

U.S. PATENT DOCUMENTS

| | | | |
|---|---|---|---|
| 8,905,788 | B2 | 12/2014 | Molex |
| 2013/0316587 | A1 | 11/2013 | Takahashi et al. |

FOREIGN PATENT DOCUMENTS

| | | | |
|---|---|---|---|
| CN | 103515792 | A | 1/2014 |
| CN | 204190038 | U | 3/2015 |
| CN | 102684020 | B | 5/2015 |
| CN | 106299825 | A | 1/2017 |
| CN | 206059757 | U | 3/2017 |
| CN | 107275827 | A | 10/2017 |
| TW | M363116 | U | 8/2009 |
| TW | M411025 | U | 9/2011 |
| TW | M551357 | U | 11/2017 |
| TW | M554647 | U | 1/2018 |

*Primary Examiner* — Ross N Gushi
(74) *Attorney, Agent, or Firm* — Ming Chieh Chang; Wei Te Chung

(57) ABSTRACT

An electrical connector includes an insulative housing and a plurality of contacts retained therein. The housing forms a central slot along a longitudinal direction, and includes a base, opposite first wall and second wall extending from the base and located by two sides of the central slot. The contact includes a retaining section retained to the corresponding first or second wall, and a spring arm with a contacting section at a free end, extending from the retaining section and into the central slot wherein a width/thickness ratio in the contacting section is set within a range between 0.8~1.28.

15 Claims, 9 Drawing Sheets

HIGH FREQUENCY ELECTRICAL CONNECTOR

BACKGROUND OF THE DISCLOSURE

1. Field of the Disclosure

The present disclosure relates to an electrical connector, and more particularly to an electrical connector for high frequency signal transmission.

2. Description of Related Arts

Signal transmission in the electrical connection system requires a consistent impedance along the transmission path. Anyhow, impedance may inevitably dropped at the mating regions between the mated plug and receptacle connector, thus resulting in an unstable transmission with improper losses. FIG. 8 is a diagram showing the impedance curve of the traditional contact with a width/thickness ratio of 1.8

An improved arrangement is desired to have the electrical connector with the properly contact arrangement for maintaining a relatively consistent impedance along the transmission path including in the mating region.

SUMMARY OF THE DISCLOSURE

An object of the invention is to provide an electrical connector with an insulative housing and a plurality of contacts retained therein. The housing forms a central slot along a longitudinal direction, and includes a base, opposite first wall and second wall extending from the base and located by two sides of the central slot. The contact includes a retaining section retained to the corresponding first or second wall, and a spring arm, with a contacting section at a free end thereof, extending from the retaining section and into the central slot wherein a width/thickness ratio in the contacting section is in a range between 0.8~1.28. Understandably, such a ratio may efficiently lower the capacitive effect, thus improving impedance matching.

The first wall forms a first mating region, a second mating region and a third mating region between the first mating region and the second mating region in the longitudinal direction. The second wall forms a fourth mating region. The contacts includes first contacts, second contacts, the third contacts and the fourth contacts respectively disposed in the corresponding first mating region, second mating region, third mating region and fourth mating region. The width/thickness ratio of the contacting can be 1 wherein both the width and thickness of each of the first contacts and the second contacts are 0.25 mm while both those of each of the third contacts and the fourth contacts are 0.20 mm Alternately, the width/thickness ratio can be 0.8 wherein the width is 0.2 mm and the thickness is 0.25 mm for both the first contact and the second contact while the width is 0.16 mm and the thickness is 0.20 mm for both the third contact and the fourth contact. Alternately, the width/thickness ratio can be 1.28 wherein the width is 0.32 mm and the thickness is 0.25 for both the first contact and the second contact while the width is 0.256 mm and the thickness is 0.2 mm for both the third contact and the fourth contact. Moreover, for enhancing the grounding effect, the second wall forms a groove to receive the grounding bar having fingers mechanically and electrically connecting the retaining sections of the corresponding fourth contacts.

Other objects, advantages and novel features of the disclosure will become more apparent from the following detailed description when taken in conjunction with the accompanying drawings.

DETAILED DESCRIPTION OF THE PREFERRED EMBODIMENT

Figure 1:
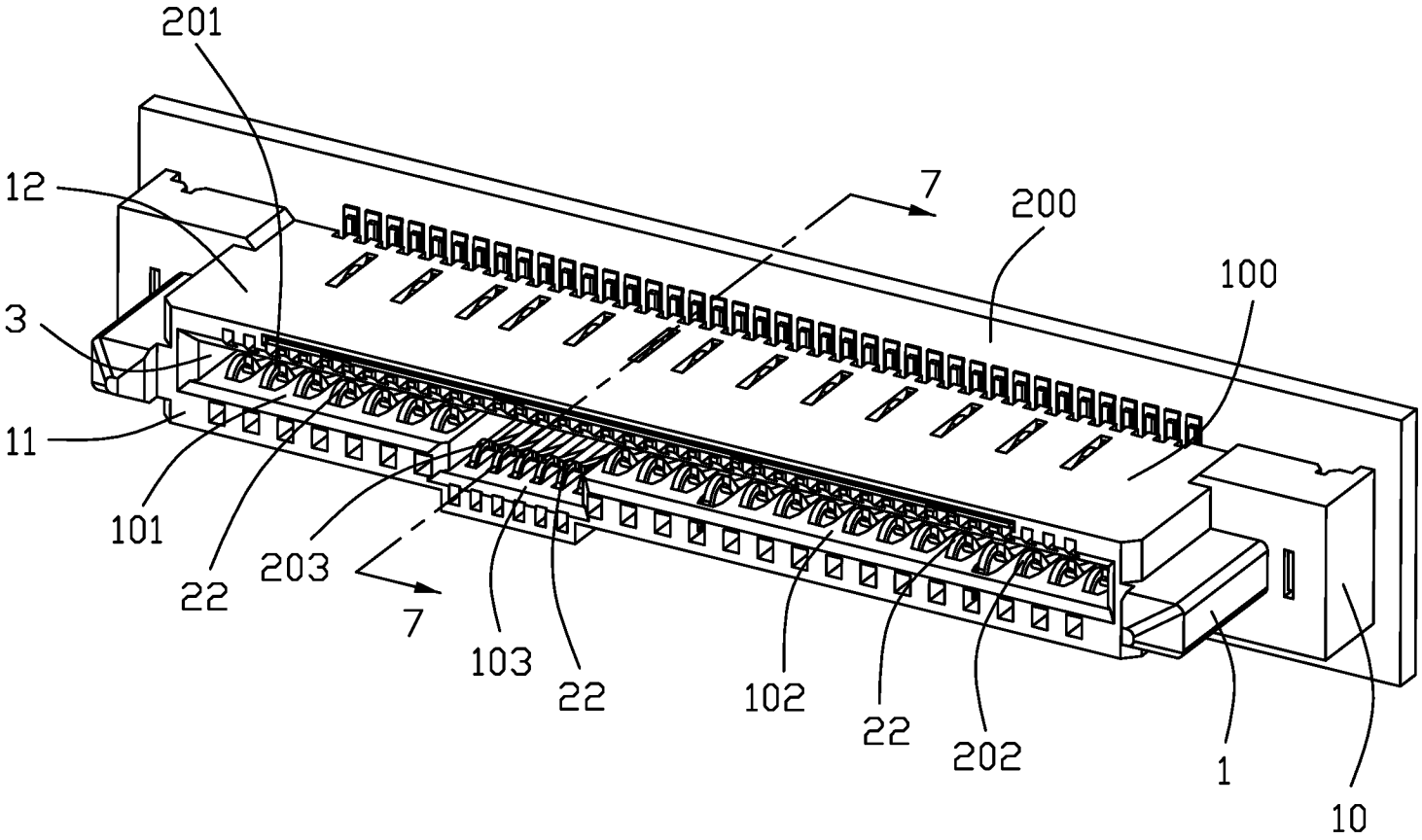
FIG. 1 is a perspective view of an electrical connector mounted upon a printed circuit board according to the invention.
Figure 2:
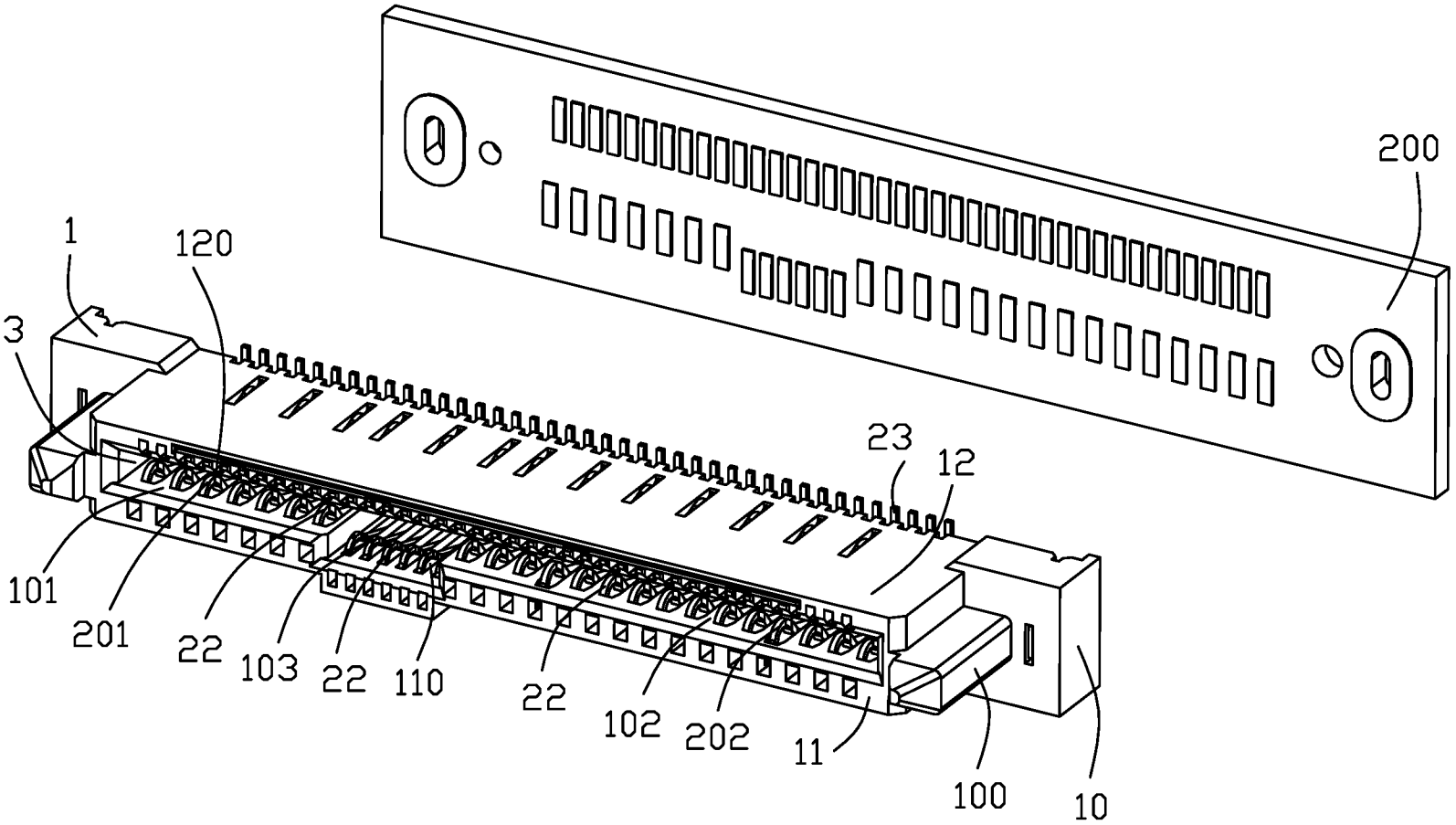
FIG. 2 is a perspective view of the electrical connector removed away from the printed circuit board of FIG. 1.
Figure 3:
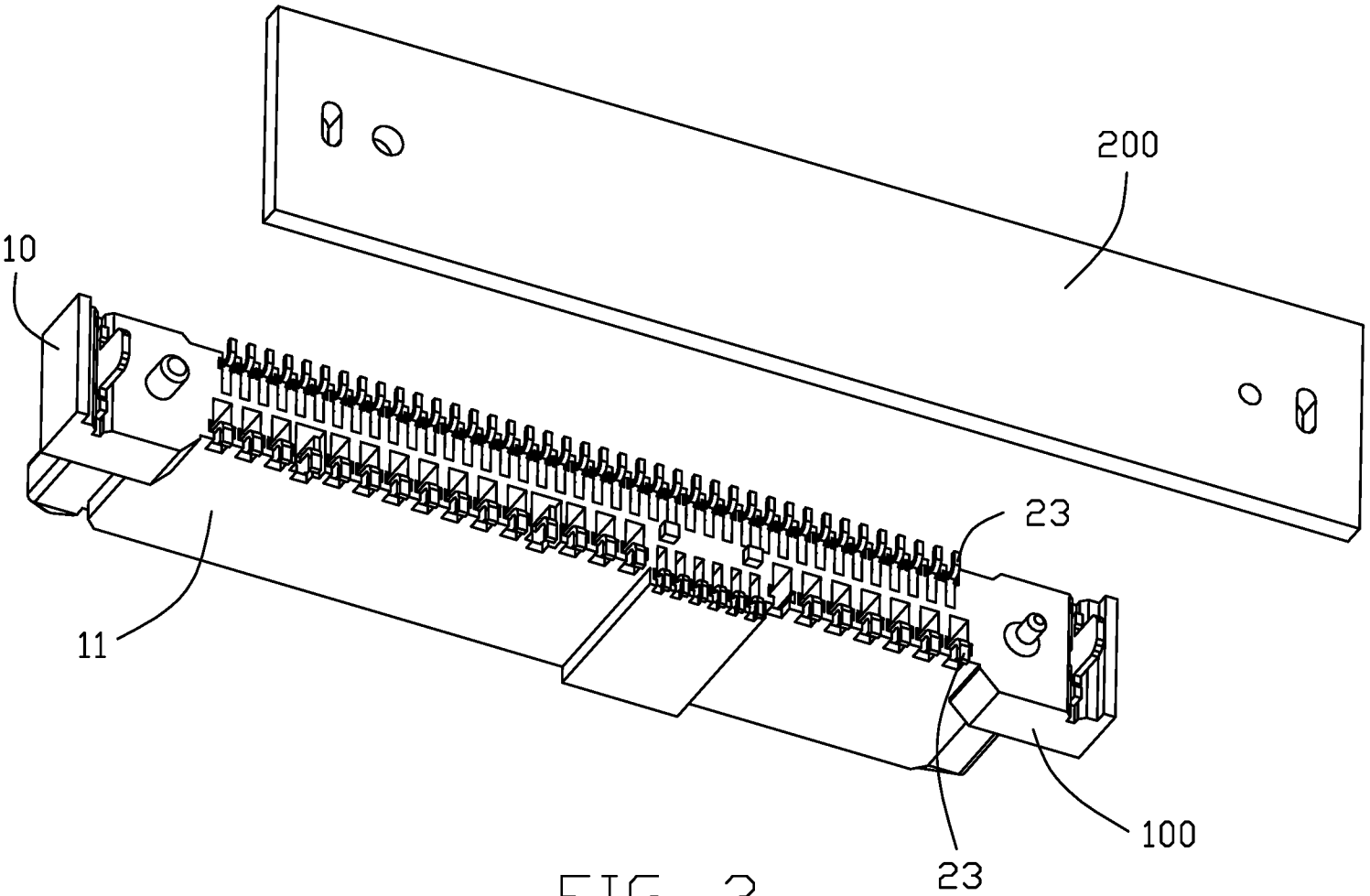
FIG. 3 is another perspective view of the electrical connector removed away from the printed circuit board of FIG. 1.
Figure 4:
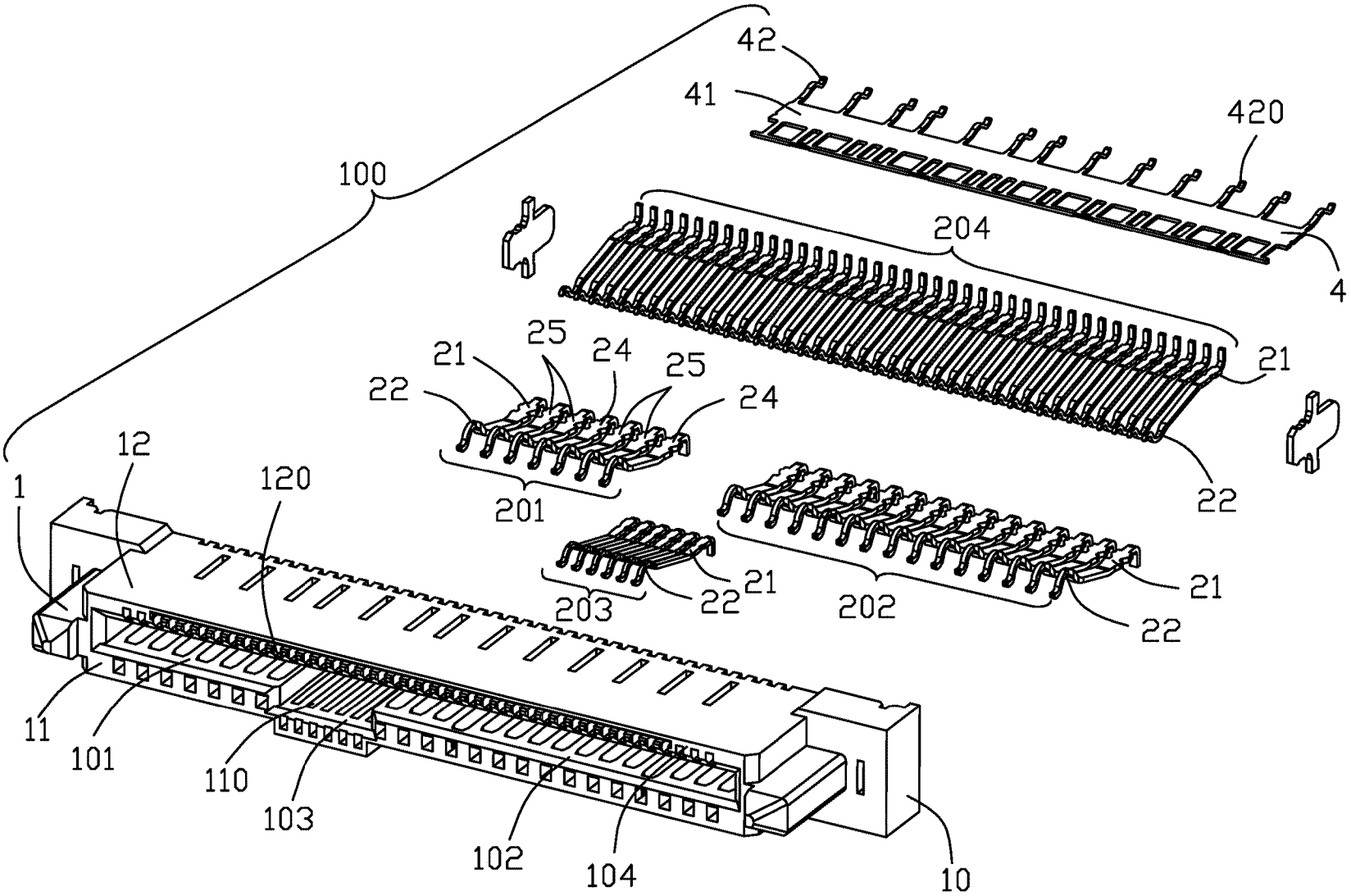
FIG. 4 is an exploded perspective view of the electrical connector of FIG. 3.
Figure 5:
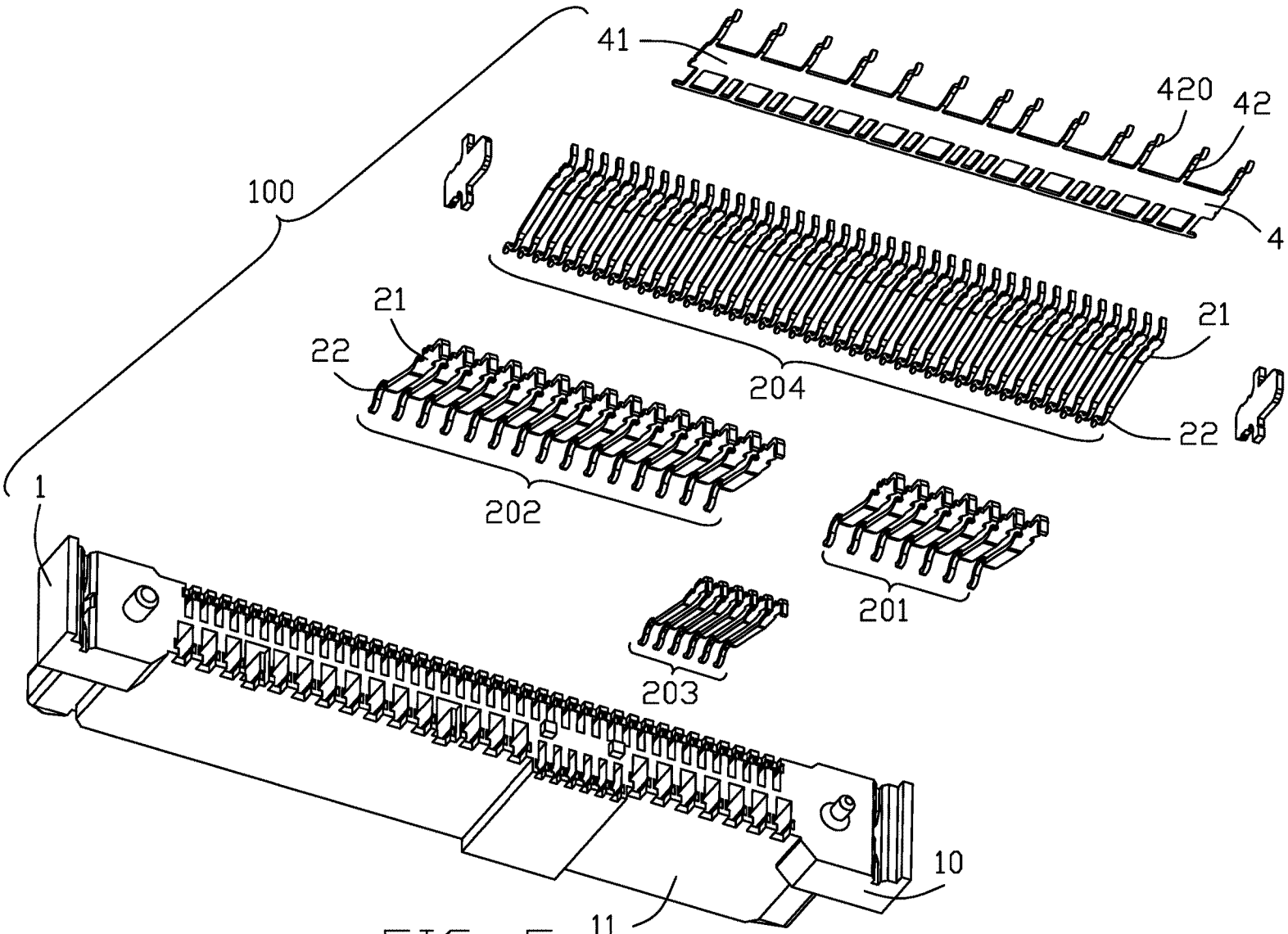
FIG. 5 is another exploded perspective view of the electrical connector of FIG. 4.
Figure 6:
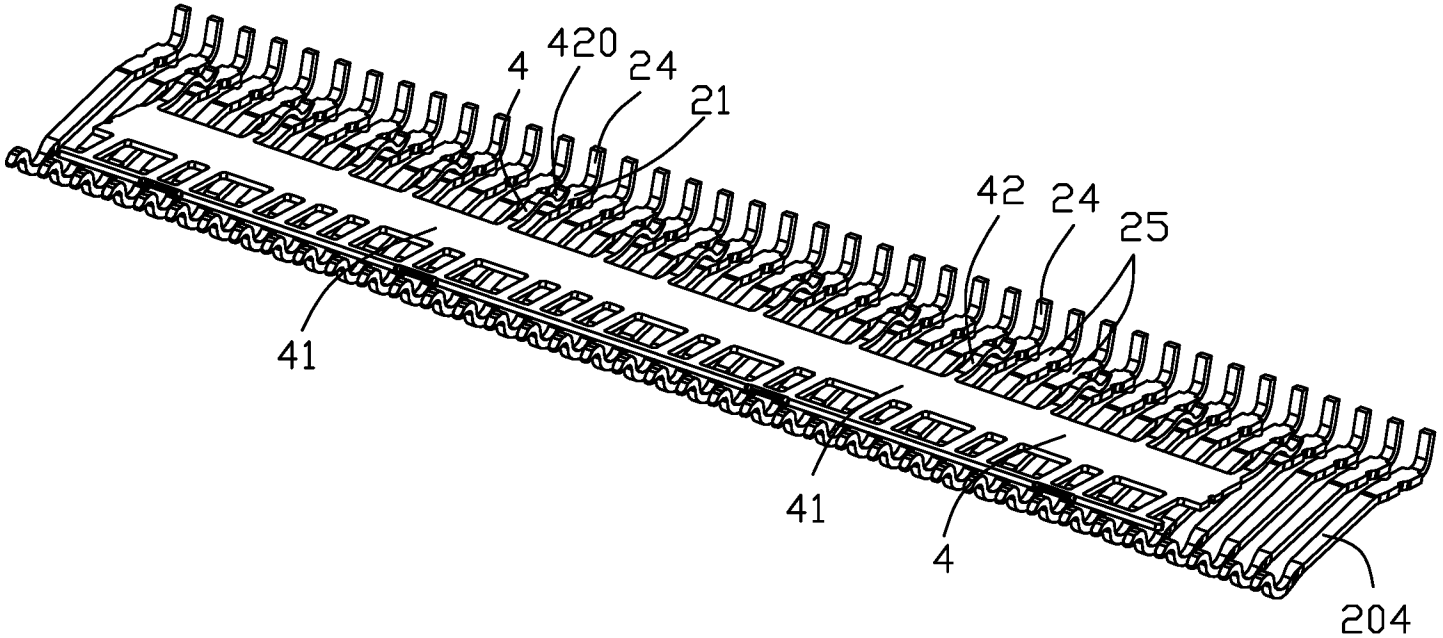
FIG. 6 is a perspective view of the grounding bar contacting the fourth contacts of the electrical connector of FIG. 1.
Figure 7:
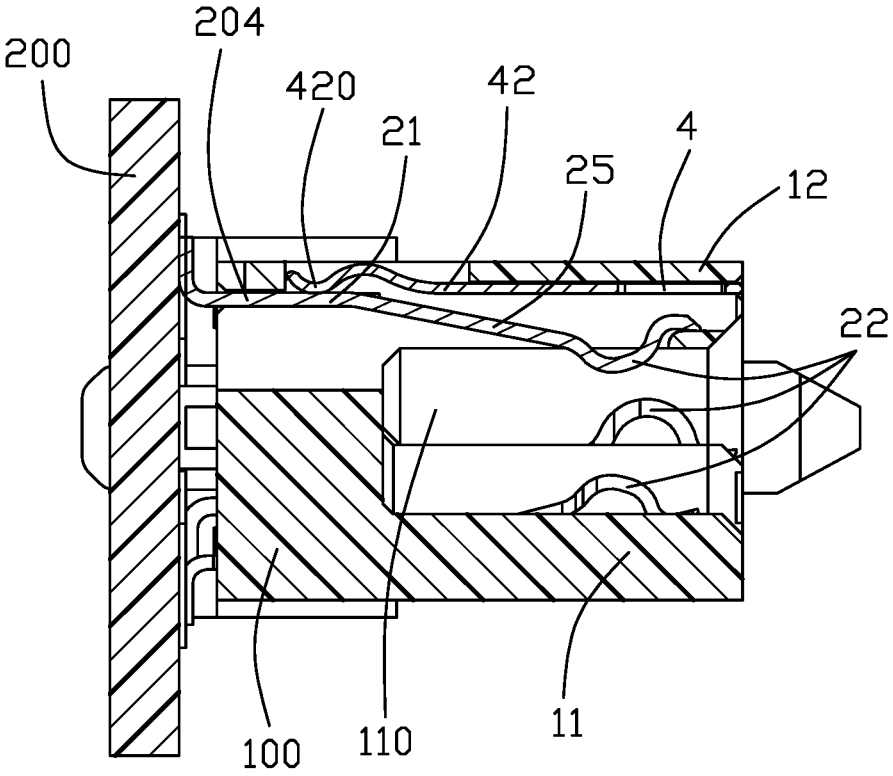
FIG. 7 is a cross-sectional view of the electrical connector of FIG. 1.

Referring to FIGS. 1-7, an electrical connector 100 includes an insulative housing 1 and a plurality of contacts 2 retained to the housing 1. The housing 1 forms a central slot 3 extending along the longitudinal direction, and includes a base 10 with opposite first wall 11 and second wall 12 extending therefrom by two sides of the central slot 3. Along the front-to-back direction perpendicular to both the longitudinal direction and the transverse direction, the contact 2 includes a middle retaining section 21 retained to the base 10, a front spring arm (not labeled) extending from the retaining section 21 with a contacting section 22 at a free end which extends into the central slot 3, and a rear solder leg 23 extending from the retaining section 21 and out of the base 10. The ratio of the width to the thickness in the contacting section 22 is in a range between 0.8~1.28. The first wall 11 includes a first mating region 101, a second mating region 102 and a third mating region 103 located in a groove 110 between the first mating region 101 and the second mating region 102. The contacts 2 includes first contacts 201, the second contacts 202 and the third contacts 203 respectively disposed within the corresponding first mating region 101, second mating region 102 and third mating region 103. The second wall 12 forms a fourth mating region 104 corresponding to all the first mating region 101, the second mating region 102 and the third mating region 103 in a transverse direction perpendicular to the longitudinal direction. The fourth contacts are disposed in the fourth mating region 104.

Figure 8:
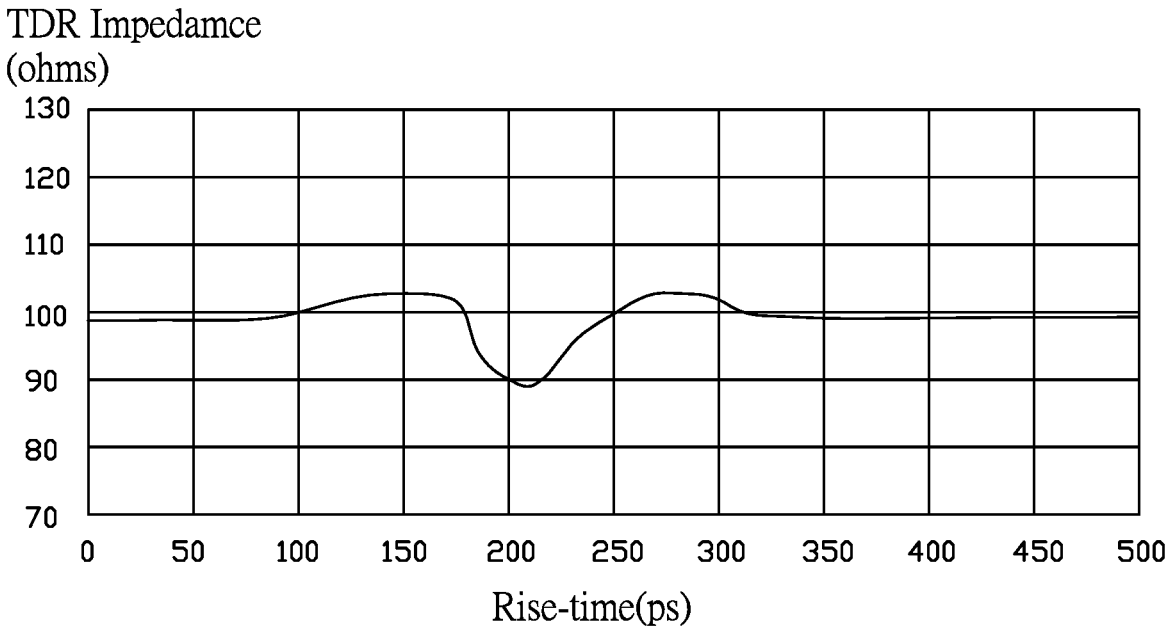
FIG. 8 is a diagram showing the impedance curve of the traditional contact.
Figure 9:
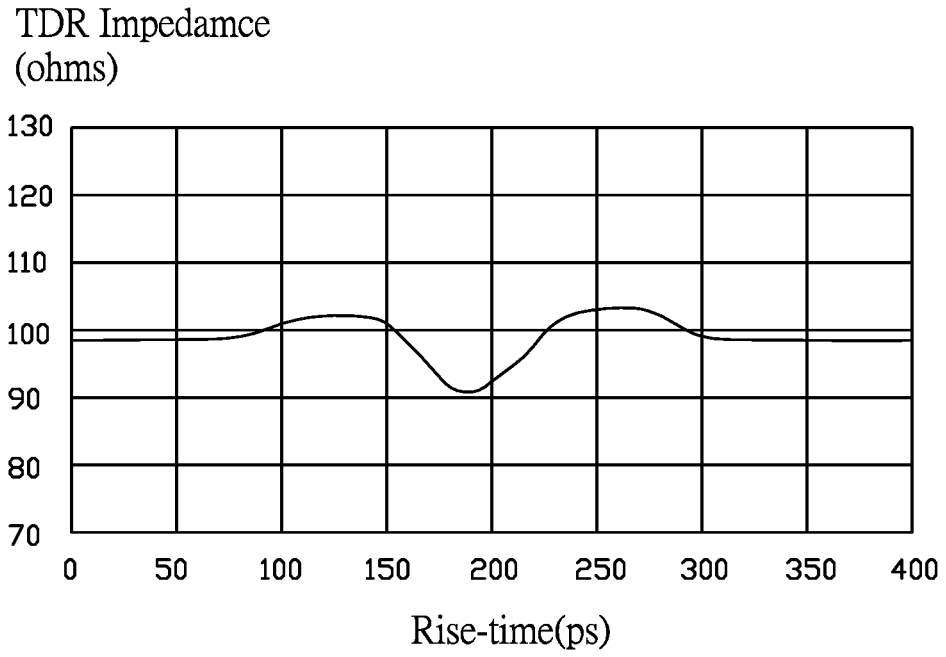
FIG. 9 is a diagram showing the impedance curve of the instant invention.

The contacts 2 includes the differential pair contacts 25 and the grounding contacts 24. In the instant invention, the ratio between the width and the thickness in the contacting section is set in a range between 0.8~1.28, compared with the value of 1.8 disclosed in the traditional contact. For example, when the ratio is equal to 1, both the width and the thickness of the first contact 201 and the second contact 202 are 0.25 mm while both the width and thickness of the third contact and the fourth contact are 0.20 mm. FIG. 9 shows the impedance curve under the instant invention, wherein the impedance of the contacting section around the mating region can be raised up, compared with that shown in FIG. 8, thus improving the impedance matching.

Alternately, when the ratio is set at 0.8, the width of the first contact 201 and that of the second contact 202 are 0.20 mm and the thicknesses thereof are 0.25 while the width of the third contact 203 and that of the fourth contact 204 are 0.16 mm and the thicknesses thereof are 0.20 mm Alternately, when the ratio is set at 1.28, the width of the first contact 201 and that of the second contact 202 are 0.32 mm and the thicknesses thereof are 0.25 mm while the width of the third contact 203 and that the fourth contact are 0.256 mm and the thicknesses thereof are 0.20 mm. In general, disregarding which value of the ratio is selected, the width of the first contact 201 and that of the second contact 202 should be five fourths of those of the third contact 203 and the fourth contact 204. Similarly, the thickness of the first contact 201 and that of the second contact 202 are also five fourths of those of the third contact 203 and the fourth contact 204. As noted, such a difference result from the different basic structure of the first contact 201 and the second contact 202 and those of the third contact 203 and the fourth contact 204 wherein the dimension and the pitch of the first contact 201 and those of the second contact 202 are significantly larger than those of the third contact 203 and the fourth contact 204. Notably, in this embodiment, the first contacts 201 are same with the second contacts 202, and the third contacts 203 are same with the fourth contacts 204. In addition, in this embodiment such a ratio in the spring arm is about 1.85 for the third contact and the fourth contact, and 2.85 for the first contact and the second contact.

To enhance the grounding effect, the second wall 12 forms a slit 120 to communicate with the fourth mating region 104. A grounding bar 4 is received within the slit 120, and includes a main body 41 and a plurality of spring tangs 42 mechanically and electrically connecting to the corresponding grounding contacts 24 of the fourth contacts 204. The spring tang 42 includes a contacting section 420 resiliently contacting a retaining section 21 of the corresponding grounding contacts 24 of the fourth contacts 204 so as to reduce resonance during transmission. Understandably, the slit 120 extends from the front mating face of the housing 1 and along an interior surface of the second wall 12 so as to allow the grounding bar 4 to be inserted into the housing from the front mating opening wherein the second wall 12 further forms a plurality of openings (not labeled) to receive the corresponding tangs 42

While a preferred embodiment in accordance with the present disclosure has been shown and described, equivalent modifications and changes known to persons skilled in the art according to the spirit of the present disclosure are considered within the scope of the present disclosure as described in the appended claims.

What is claimed is:

1. An electrical connector comprising:

an insulative housing forming a central slot extending along a longitudinal direction, and including a base with opposite first wall and second wall extending therefrom and located by two sides of the central slot in a transverse direction perpendicular to the longitudinal direction; and a plurality of contacts disposed in the housing, each of said contacts including a retaining section retained to the base, a resilient spring arm extending from the retaining section with a contacting section at a free end in the central slot, and a soldering leg extending out of the housing;

wherein in the contacting section, a ratio of width to thickness is within a range between 0.8 and 1.28.

2. The electrical connector as claimed in claim 1, wherein the first wall defines a first mating region, a second mating region and a third mating region located between the first mating region and the second mating region in the longitudinal direction, and the second wall defines a fourth mating region, the contacts include first contacts in the first mating region, second contacts in the second mating region, third contacts in the third mating region, and fourth contacts in the fourth mating region, the first contacts being similar to the second contacts, and the third contacts being similar to the fourth contacts.

3. The electrical connector as claimed in claim 2, wherein when the ratio is equal to 1, the width and the thickness of the first contacts and those of the contacts are 0.25 mm, and those of the third contacts and the fourth contacts are 0.20 mm.

4. The electrical connector as claimed in claim 2, wherein when the ratio is equal to 0.8, the width of the first contacts and that of the second contacts are 0.20 mm and the thickness of the first contacts and that of the second contacts are 0.25 mm, while the width of the third contacts and that of the fourth contacts are 0.16 mm and the thickness of the third contacts and that of the fourth contacts are 0.20 mm.

5. The electrical connector as claimed in claim 2, wherein when the ratio is equal to 1.28, the width of the first contacts and that of the second contacts are 0.32 mm and the thicknesses thereof are 0.25 mm while the width of the third contacts and that of the fourth contacts are 0.256 mm and the thicknesses thereof are 0.20 mm.

6. The electrical connector as claimed in claim 1, wherein the width of the first contacts and that of the second contacts in the corresponding contacting section is five fourths of those of the third contacts and the fourth contacts in the corresponding contacting section.

7. The electrical connector as claimed in claim 6, wherein a ratio of the width to the thickness in the spring arm of the third contacts and the fourth contacts is about 1.85 while is about 2.85 in the spring arm of the first contacts and the second contacts.

8. The electrical connector as claimed in claim 7, wherein an average width of the first contacts and that of the second contacts is larger than those of the third contacts and the fourth contacts.

9. The electrical connector as claimed in claim 8, where a pitch of the first contacts and that of the second contacts are larger than those of the third contacts and the fourth contacts.

10. The electrical connector as claimed in claim 1, wherein a slit is formed in the second wall and communicating with the fourth mating region, and a grounding bar is received within the slit with spring tangs contacting corresponding grounding contacts of the fourth contacts.

11. The electrical connector as claimed in claim 10, wherein the slit extends through a front mating face of the housing.

12. An electrical connector comprising:

an insulative housing forming a central slot extending along a longitudinal direction, and including a base with opposite first wall and second wall extending therefrom and located by two sides of the central slot in a transverse direction perpendicular to the longitudinal direction, a slit formed in an interior surface of the second wall and extending through a front mating face of the housing through which the central slot extends rearwardly, a plurality of openings formed in the second wall to communicate with an exterior in the transverse direction;

a plurality of contacts disposed in the housing, each of said contacts including a retaining section retained to the base, a resilient spring arm extending from the retaining section with a contacting section at a free end in the central slot, and a soldering leg extending out of the housing, the contacts including a plurality of grounding contacts communicatively aligned with the openings in the transverse direction; and a ground bar having a main body inserted into the slit from the mating face and a plurality of spring tangs extending from the main body and into the corresponding openings to mechanically and electrically connect the corresponding grounding contacts, respectively.

13. The electrical connector as claimed in claim 12, wherein the spring tangs of the grounding bar contact the retaining sections of the corresponding grounding contacts, respectively.

14. The electrical connector as claimed in claim 13, wherein in the contacting section of each contact, a ratio of a width to a thickness is about 0.8~4.28.

15. The electrical connector as claimed in claim 14, wherein in the spring arm of each contact, another ratio of the width to the thickness is about 1.85~2.85.

* * * * *